United States Patent [19]

Rozzi

[11] Patent Number: 4,831,699

[45] Date of Patent: May 23, 1989

[54] PROCESS FOR MAKING CURVED WALLS STARTING WITH A FLAT PREFABRICATED PANEL FORMED FROM THREE-DIMENSIONAL METAL SCREEN WITH FORMED PLASTIC FILLING

[75] Inventor: Costantino Rozzi, Ascoli Piceno, Italy

[73] Assignee: R.E.IN. S.p.A., Italy

[21] Appl. No.: 62,477

[22] Filed: Jun. 12, 1987

[30] Foreign Application Priority Data

Jun. 16, 1986 [IT] Italy ..... 20795 A/86

[51] Int. Cl.[4] ..... B23P 17/00

[52] U.S. Cl. ..... 29/155 R; 29/445; 29/458; 29/460; 52/249; 52/309.7; 52/631; 228/170; 228/173.5

[58] Field of Search ..... 29/445, 155 R, 460, 29/458; 228/153, 170, 173.5; 52/309.7, 309.9, 631, 309.12, 249, 378

[56] References Cited

U.S. PATENT DOCUMENTS

| | | | |
|---|---|---|---|
| 3,404,500 | 10/1968 | Akita et al. | 52/249 |
| 3,440,790 | 4/1969 | Nerem | 52/631 |
| 3,562,973 | 2/1971 | Gangemi | 52/631 X |
| 3,989,329 | 11/1976 | Benford | 52/631 X |
| 4,024,684 | 5/1977 | Holmgren | 52/631 X |
| 4,505,019 | 3/1985 | Deinzer | 29/155 R X |
| 4,614,013 | 9/1986 | Stevenson | 29/155 R |
| 4,671,035 | 6/1987 | Ridge | 52/631 |

*Primary Examiner*—Charlie T. Moon

*Attorney, Agent, or Firm*—Steele, Gould & Fried

[57] ABSTRACT

A flat prefabricated panel formed from a three-dimensional metal screen and from a reference layer of foamed plastic is converted into a curved panel suitable for the formation of a curved wall by cutting said screen along parallel lines on one face of the panel, utilizing said cut line to incurvate the panel to make the opposite face thereof concave and finally restoring the integrity of the screen on said face of the panel by means of reticular connecting strips applied along said cutting lines.

2 Claims, 2 Drawing Sheets

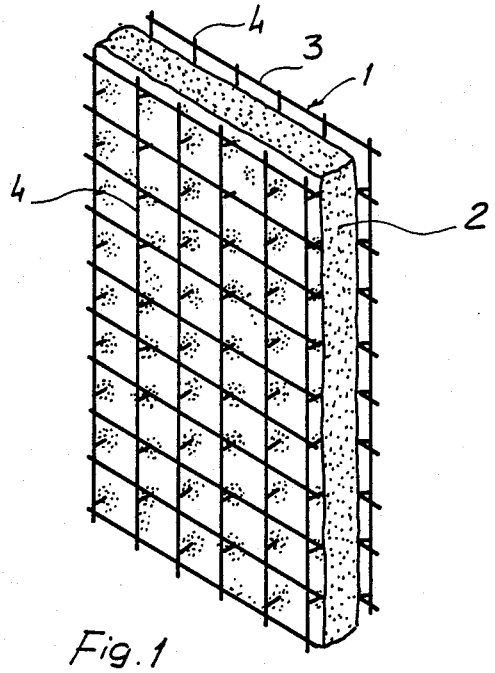
Fig. 1
Fig. 2
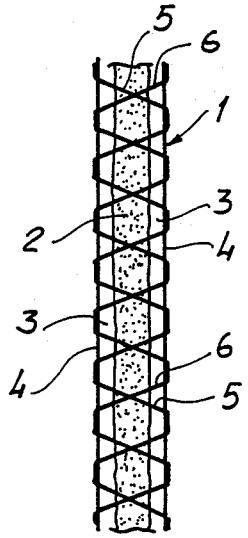
Fig. 5
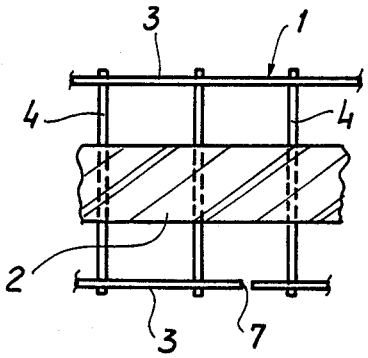
Fig. 7
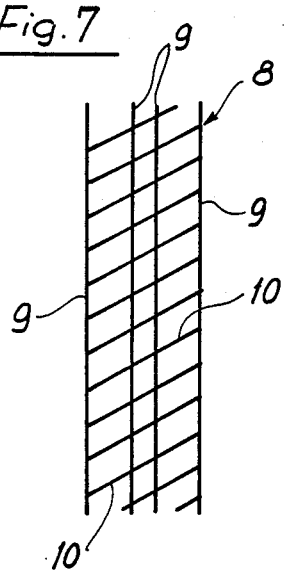

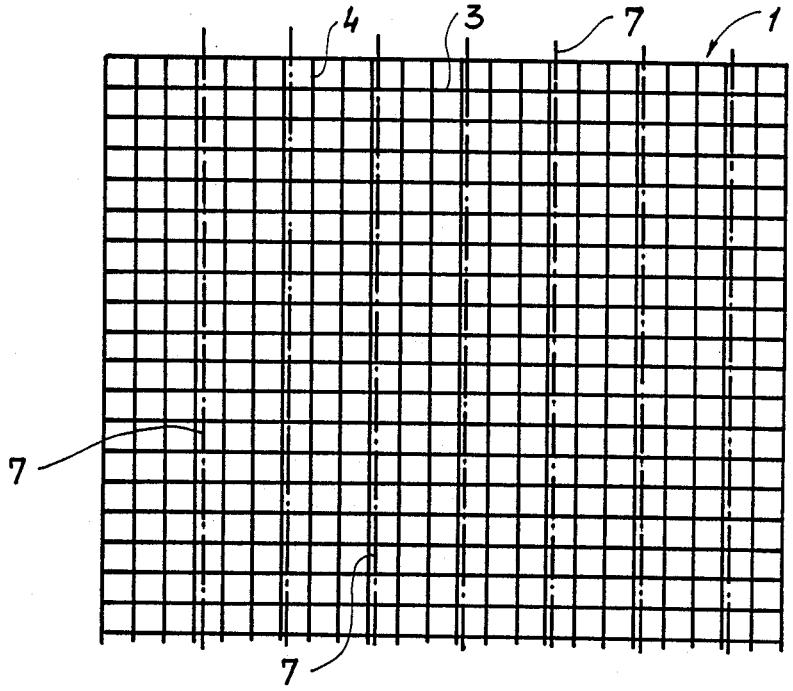
Fig. 3
Fig. 4
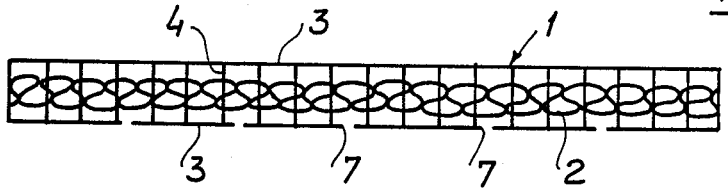
Fig. 6
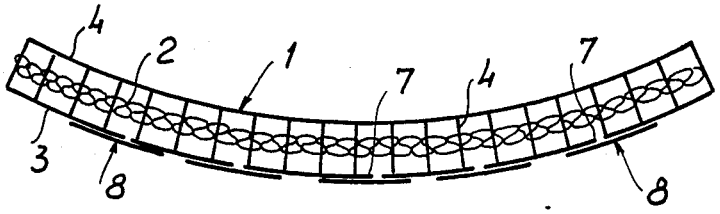

PROCESS FOR MAKING CURVED WALLS STARTING WITH A FLAT PREFABRICATED PANEL FORMED FROM THREE-DIMENSIONAL METAL SCREEN WITH FORMED PLASTIC FILLING

DESCRIPTION

The present invention relates to a process for making curved walls starting with a flat prefabricated panel formed from three-dimensional metal screen with foamed plastic filling.

Prefabricated building panels comprising a three-dimensional metal screen partially filled with an interior layer of foamed plastic material are known.

Due to the effect of the abovesaid structure said panels are essentially flat and, at least in appearance, do not lend themselves to making a curved wall.

The object of the present invention is to provide a process for making curved walls starting with a flat panel of the abovesaid type.

In accordance with the invention said object is achieved by a process characterized in that it comprises cuts in parallel lines of said screen on one face of the panel, curving the panel utilizing said cutting lines to make the opposite face of the panel concave, then restoration of the integrity of the screen on said face of the panel by means of reticular connecting strips applied along said cut lines.

In a very simple and rapid manner an essentially flat panel is thus converted into a curved panel suitable for making curved walls.

For better understanding of the invention reference will be made to the annexed drawings wherein:

FIG. 1 shows a perspective view of a piece of flat prefabricated panel which the process in accordance with the invention converts into a curved panel, FIG. 2 shows a cross section of said panel along the line II—II of FIG. 1, FIG. 3 shows the front elevation of the panel of FIGS. 1 and 2 with one face thereof cut along vertical parallel lines, FIG. 4 shows a top view of the panel in the same condition, FIG. 5 shows an enlarged view of a detail of the panel of FIG. 4, FIG. 6 shows the curved panel with the integrity of the convex face restored by application of reticular connecting strips, and FIG. 7 shows the front elevation of said connecting strips.

FIGS. 1 and 2 show a flat prefabricated building panel consisting of a three-dimensional metal screen partially filled with a flat layer 2 of foamed plastic such as, for example, polyurethane foam.

The three-dimensional screen 1 is in reality formed from two parallel flat nets with perpendicular rows 3 and 4 joined together by cross-pieces 5 and 6 alternately inclined first in one direction and then in the opposite direction as may be seen in FIG. 2.

The structure of this screen and in general of the entire panel is known in itself and will therefore not be explained further.

To convert the flat panel shown in FIGS. 1 and 2 into a curved panel suitable for making curved walls the horizontal wires of one of the two parallel nets are cut along parallel vertical lines shown schematically and indicated with reference number 7 in the front elevation of FIG. 3. The same reference number indicates in the top view of FIGS. 4 and 5 the cuts made in said horizontal wires 3.

It thus becomes possible to bend the panel in such a manner as to make the face having the cuts 7 convex and the opposite face concave. This is clearly allowed by the cuts made in the flat net in combination with the deformability of the uncut flat net and the filling layer 2.

In this manner there is obtained the curved panel shown in FIG. 6, the integrity of the face of which is restored by using over each cut line 7 a reticular connecting strip 8 of the type shown in FIG. 7, i.e. formed of vertical wires 9 connected by oblique cross-pieces 10.

The strips 8 are appropriately connected, e.g. by welding, to the perpendicular wires 3 and 4 of the cut net to obtain the finished curved panel shown in FIG. 6.

I claim:

1. A process for forming curved walls from a flat prefabricated panel formed by a three-dimensional grid of metal wires having a first metal wire net on one face, a spaced second metal wire net on an opposite parallel face, and metal wire cross-pieces interconnecting said spaced first and second nets, comprising the steps of:

(a) cutting the metal wires of said first net along parallel lines at one face of the grid;

(b) curving the grid around an axis parallel to the cutting lines to make the opposite face of the grid concave and said one face convex to form gaps in the wires of said first net;

(c) attaching net-like flat connecting strips over said gaps in said first net formed at the cutting lines during curving to restore the integrity of the metal wires of said first net at said one face.

2. A process according to claim 1, wherein said three-dimensional grid has an internal space partially filled with a foamed plastic layer, which is curved from an original flat condition to a final curved condition during curving of the grid.

* * * * *